US009950234B2

(12) United States Patent
Park

(10) Patent No.: US 9,950,234 B2
(45) Date of Patent: Apr. 24, 2018

(54) SOUND GENERATOR FOR GOLF PRACTICE

(71) Applicant: Chan-Jae Park, Anyang-si (KR)

(72) Inventor: Chan-Jae Park, Anyang-si (KR)

( * ) Notice: Subject to any disclaimer, the term of this patent is extended or adjusted under 35 U.S.C. 154(b) by 0 days.

(21) Appl. No.: 15/329,133

(22) PCT Filed: Jun. 16, 2015

(86) PCT No.: PCT/KR2015/006097
§ 371 (c)(1),
(2) Date: Jan. 25, 2017

(87) PCT Pub. No.: WO2016/017923
PCT Pub. Date: Feb. 4, 2016

(65) Prior Publication Data

US 2017/0216699 A1 Aug. 3, 2017

(30) Foreign Application Priority Data

Jul. 30, 2014 (KR) ..... 10-2014-0097345

(51) Int. Cl.
*A63B 69/36* (2006.01)

(52) U.S. Cl.
CPC ..... *A63B 69/36* (2013.01); *A63B 2208/0204* (2013.01)

(58) Field of Classification Search
USPC ..... 473/204–206, 216, 228, 234, 285, 286, 473/408
See application file for complete search history.

(56) References Cited

U.S. PATENT DOCUMENTS 3,776,556 A * 12/1973 McLaughlin ..... A63B 69/3635 446/216
4,094,504 A * 6/1978 Barasch ..... A63B 69/3635 473/234
4,283,057 A * 8/1981 Ragan ..... A63B 53/04 446/216
5,984,799 A * 11/1999 Romano ..... A63B 69/3635 473/234
6,413,167 B1 7/2002 Burke
6,899,633 B1 * 5/2005 Kienzle ..... A63B 69/3635 473/224
8,123,625 B2 * 2/2012 Martovitz ..... A01K 87/007 473/228
9,492,728 B2 * 11/2016 Monroe ..... A63B 69/3635
(Continued)

FOREIGN PATENT DOCUMENTS

KR 1020050115500 A 12/2005
KR 1020050116237 A 12/2005
(Continued)

*Primary Examiner* — Nini Legesse
(74) *Attorney, Agent, or Firm* — Maschoff Brennan

(57) ABSTRACT

The present invention relates to a sound generator for golf practice and includes: a main body having a sound generating portion from which sound is generated and a curved portion for supporting a golf club; and gripping means for keeping the golf club fixed to the curved portion. This sound generator has a structure from which sound is varied according to the speed of a swing as air enters in the direction in which a golf club is swung. Thus, a user can listen to the sound and increase or reduce the speed of a swing to conveniently practice golf.

5 Claims, 4 Drawing Sheets

(56) References Cited

U.S. PATENT DOCUMENTS

| | | | | |
|---|---|---|---|---|
| 2004/0180729 | A1 | 9/2004 | Koncelik, Jr. | |
| 2012/0289353 | A1 | 11/2012 | Kim | |
| 2013/0085008 | A1 * | 4/2013 | Hall | A63B 69/3632 473/224 |

FOREIGN PATENT DOCUMENTS

| | | | |
|---|---|---|---|
| KR | 1020050116595 | A | 12/2005 |
| KR | 1020120091943 | A | 8/2012 |

* cited by examiner

[Fig. 1]
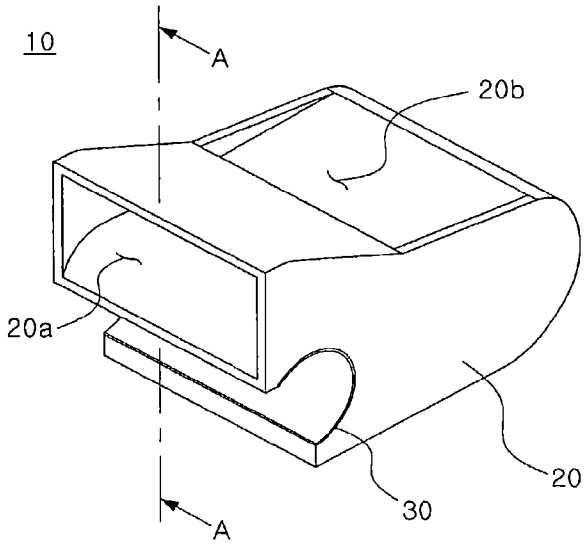
[Fig. 2]
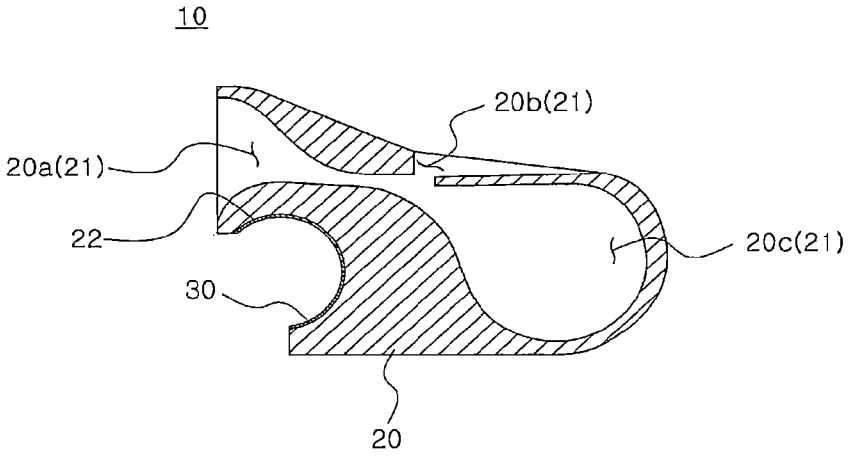
[Fig. 3]
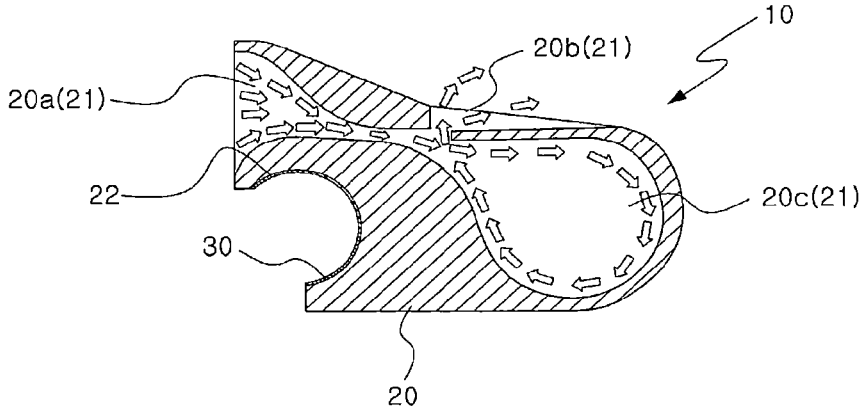

[Fig. 4]
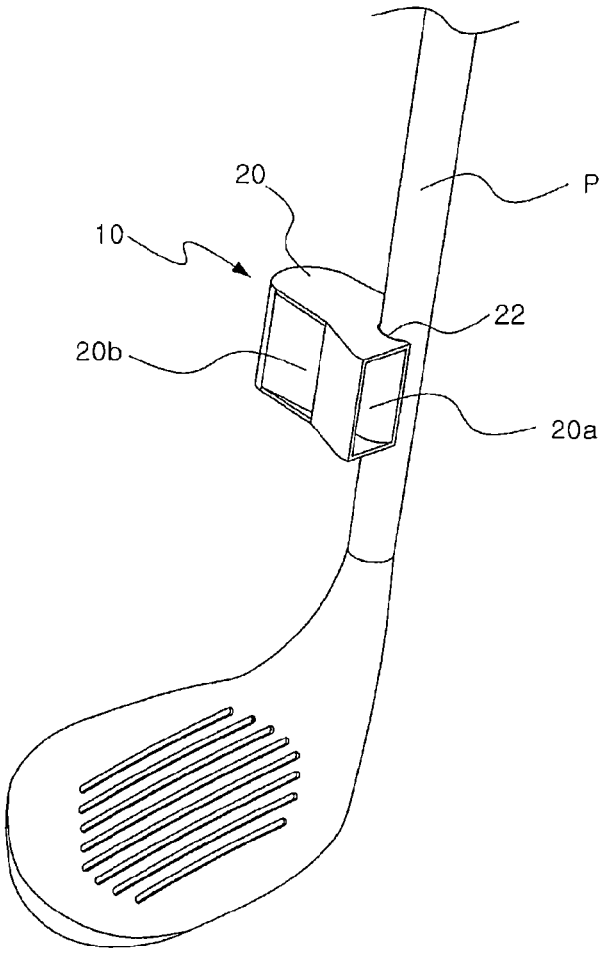
[Fig. 5]
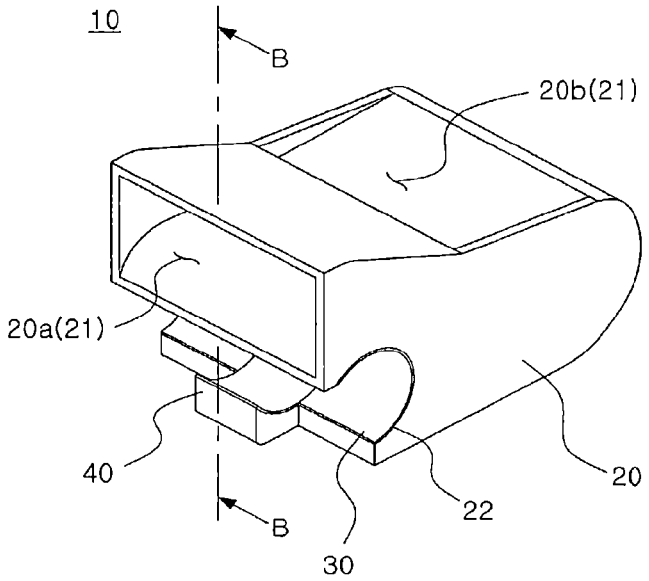

[Fig. 6]
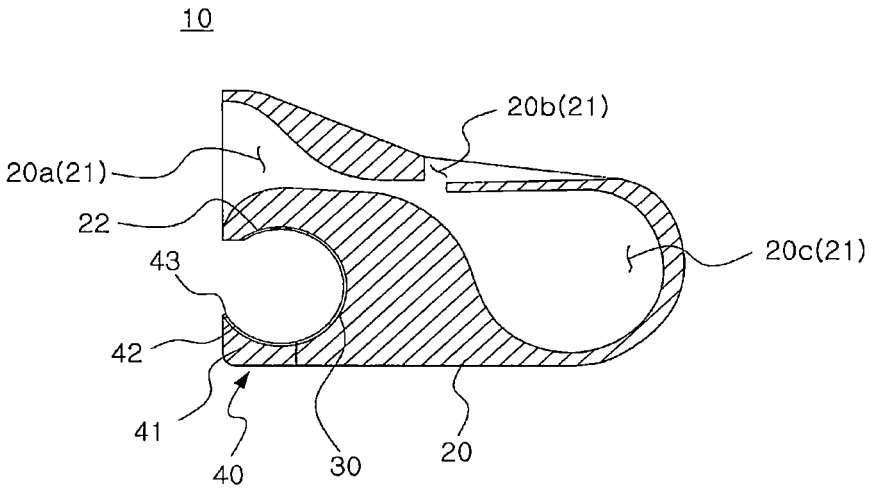
[Fig. 7]
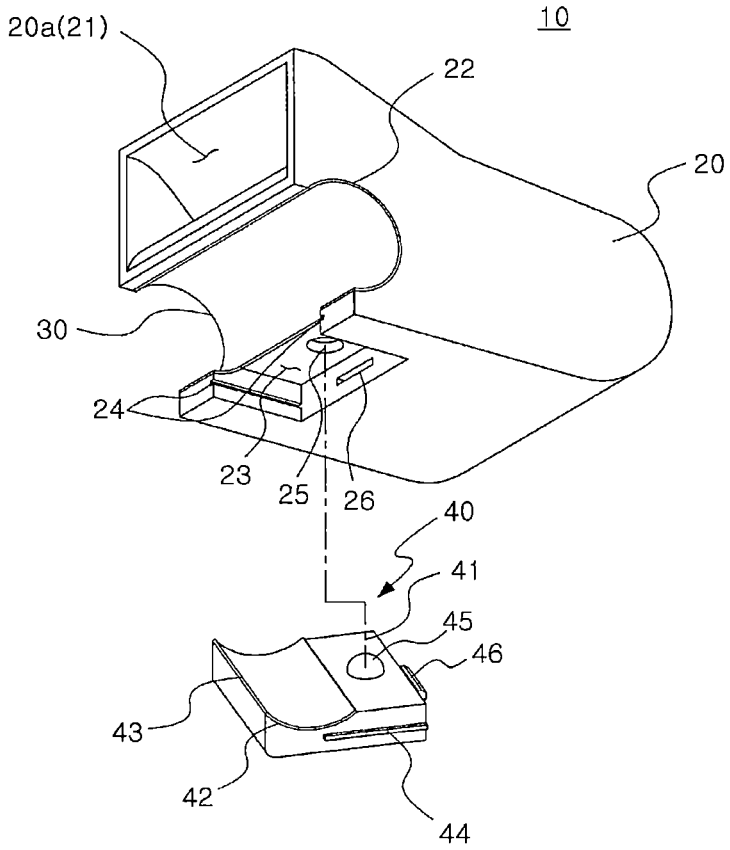

[Fig. 8]
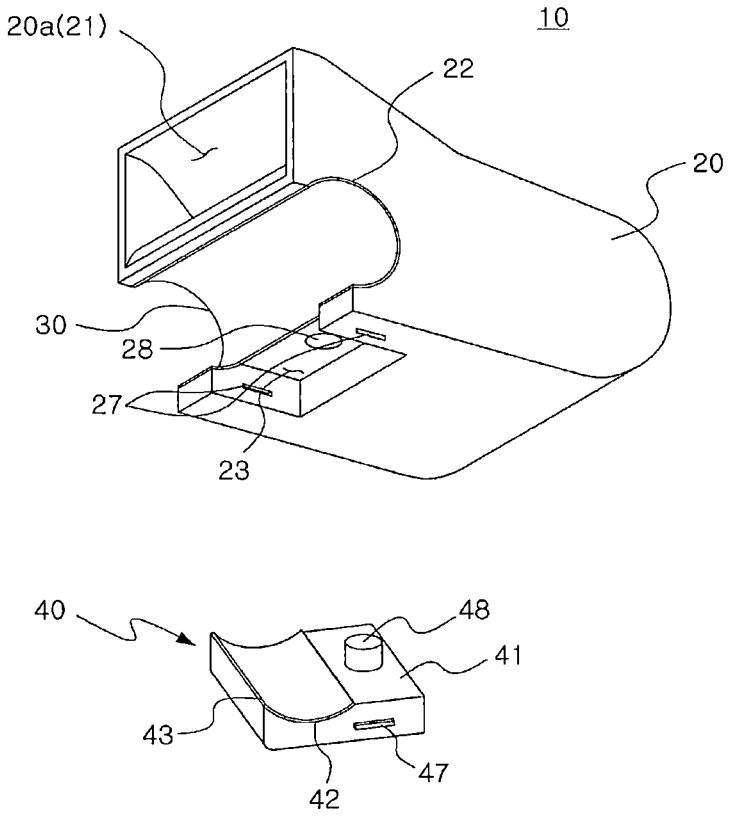
[Fig. 9]
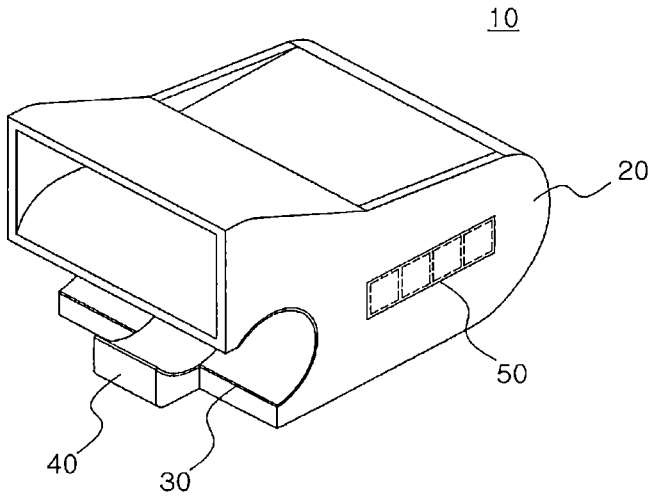

SOUND GENERATOR FOR GOLF PRACTICE

BACKGROUND OF THE INVENTION

Field of the Invention

The present invention relates to a sound generator for golf practice, and more particularly, to a sound generator for golf practice, which can be attached to a golf club, and can have a generated sound changed according to a swing speed every time a user hits with the golf club or swings the golf club, thereby giving a boost when the user practices golf.

Description of Related Art

In general, when learning golf first, a golfer should take a correct posture because golf strokes are determined depending on a basic posture, and advice of an instructor is needed, and also, it is important to have repetitious practice while keeping a swing posture suitable to a golfer.

In recent years, various devices have been developed to be easily used by users having golf practice. From among these, a device for generating a sound when a user swings a golf club is helping users have golf practice by themselves.

Korean Patent Publication No. 2013-0096129 discloses that a sound instrument is formed to be surrounded by a shaft fixing instrument, and, in a state in which the opened upper end of the shaft fixing instrument is inserted into the club shaft, the sound instrument is fixed through a shaft fixing means primarily and then is fixed through a fixing tape secondarily.

However, since the above-described patent document has a structure in which an entrance of the sound instrument is disposed in parallel with the axis direction of the club shaft and thus it is difficult for air to enter when the shaft is swung. Therefore, there is a demerit that a sound is not changed according to a swing speed.

In addition, in the state in which a portion of the shaft fixing instrument of the sound instrument is inserted into the club shaft, the sound instrument is fixed through the shaft fixing means primarily and is fixed through the fixing tap secondarily. Therefore, the sound instrument is securely fixed while being mounted on the club shaft. However, the process of doubly mounting the sound instrument on the club shaft to fix the sound instrument makes a user feel inconvenience, and also, the process of detaching the sound instrument from the club shaft after golf practice is also problematic.

SUMMARY OF THE INVENTION

An object of the present invention has been suggested to solve the above-mentioned problems, and is to provide a sound generator for golf practice which can have a sound changed according to a swing speed every time a user swings a golf club, thereby providing a rhythmic sense to the user and giving a boost when the user has golf practice.

Another object of the present invention is to provide a sound generator for golf practice which can be securely fixed to a golf club while being mounted on the golf club, and can be easily attached and detached to and from the golf club by a simple operation.

To achieve the above-described objects, the present invention includes: a main body having a sound generation portion for generating a sound, and a curved portion for supporting a golf club; and a gripping means for keeping the golf club fixed to the curved portion, and allows air to flow into the main body in a swing direction every time the golf club is swung at a predetermined swing speed, and generates a sound in the sound generation portion.

The sound generation portion may include an air inlet and an air outlet formed on the front surface and the top surface of the main body, respectively, and a sound generation space formed inside the main body, and may be configured to have a level of a sound changed according to a swing speed of the golf club.

The gripping means may include: a pad formed along the surface of the curved portion; and a grip portion extending from the curved portion by means of a fixing means, thereby enlarging a contact area with the golf club.

The fixing means may include: a first connection portion formed on the lower portion of the curved portion to be connected with the grip portion in a sliding manner; and a second connection portion formed on the grip portion to be engaged with the first connection portion.

The first connection portion may include: an insertion groove formed on the lower portion of the curved portion; guide rail grooves formed on the opposite side surfaces of the insertion groove in parallel with each other in a longitudinal direction; a location determination hole formed on the upper surface of the insertion groove between the guide rails; and a locking groove formed on the rear portion of the insertion groove, and the second connection portion may include: guide rails formed on the opposite sides of a body of the grip portion to be connected with the guide rail grooves by sliding thereinto, a location determination protrusion formed on the top surface of the body to be inserted into the location determination hole; and a locking projection formed on the rear surface of the body to be connected with the locking groove.

According to the sound generator for golf practice according to the present invention, air flows in a direction in which a golf club swings, and a sound is changed according to a swing speed. Therefore, a user may have swing practice while increasing or reducing the swing speed by listening to the sound. Therefore, an acoustical element can help image training and also can enhance training efficiency.

In addition, since a regular sound is generated every time a user swings a golf club at constant speed, the user can have a motion rhythmic sense based on the generated sound and can check user's swing posture by herself/himself.

The sound generator is configured to be mounted on a golf club by means of the gripping means, such that it can be easily and simply mounted and dismounted, and can be mounted and securely fixed to the golf club.

BRIEF DESCRIPTION OF THE DRAWINGS

FIG. 1 is a perspective view showing a sound generator for golf practice according to a first embodiment of the present invention;

FIG. 2 is a cross section view taken along line A-A of FIG. 1;

FIG. 3 is a cross section view showing an air flow in a main body of the sound generator according to the first embodiment of the present invention;

FIG. 4 is a view showing a state in which the sound generator according to the first embodiment of the present invention is mounted on a golf club;

FIG. 5 is a perspective view showing a sound generator for golf practice according to a second embodiment of the present invention;

FIG. 6 is a cross-section view taken along line B-B of FIG. 5;

FIG. 7 is an exploded perspective view showing a main body and a grip portion of the sound generator according to the second embodiment of the present invention;

FIG. 8 is an exploded perspective view showing a main body and a grip portion of a sound generator according to a third embodiment of the present invention; and FIG. 9 is a perspective view showing a sound generator for golf practice according to a fourth embodiment of the present invention.

DETAILED DESCRIPTION OF THE PREFERRED EMBODIMENTS

Hereinafter, preferred embodiments of a sound generator for golf practice according to the present invention will be described in detail with reference to the accompanying drawings.

FIG. 1 is a perspective view showing a sound generator for golf practice according to a first embodiment of the present invention, FIG. 2 is a cross section view taken along line A-A of FIG. 1, and FIG. 3 is a cross section view showing an air flow in a main body of the sound generator according to the first embodiment of the present invention.

The sound generator 10 for golf practice according to the first embodiment of the present invention includes a main body 20 having a sound generation portion 21 and a curved portion 22, and a gripping means for keeping a golf club fixed to the curved portion 22 as shown in FIGS. 1 and 2.

As shown in FIGS. 2 and 3, the sound generation portion 21 includes an air inlet 20*a* formed on the front surface of the main body 20 to allow air to enter therethrough, an air outlet 20*b* formed on the top surface of the main body 20 to discharge air therethrough, and a sound generation space 20*c* formed inside the main body 20.

Herein, the reason why the air inlet 20*a* is formed on the front surface of the main body 20 is to allow air to enter as it is when the golf club P is swung. The air inlet 20*a* may have a curved surface formed on the bottom thereof in order to reduce the air resistance. In addition, the air inlet 20*a* may be formed on the front surface of the main body 20 as large as possible so as to allow enough air to enter therethrough.

The air outlet 20*b* is formed to allow air entering through the air inlet 20*a* to be discharged to the outside via the sound generation space 20*c* as shown in FIG. 3. Herein, the air outlet 20*b* is not necessarily formed on the top surface of the main body 20 and may be formed differently depending on how the sound generation space 20*c* is formed.

The sound generation space 20*c* is formed to have a passage gradually becoming narrower from the air inlet 20*a* toward the inside and have a large space in the main body 20.

The sound generation portion 21 is configured to generate a sound through resonance while the air entering through the air inlet 20*a* passes through a narrowed-enlarged passage, is circulated along the sound generation space 20*c*, and escapes through the air outlet 20*b*.

Herein, a level of sound depends on the flow speed of air entering through the air inlet 20*a*. That is, when the swing speed of the golf club is fast and the flow speed of air entering through the air inlet 20*a* is fast, a high level of sound is generated, whereas, when the flow speed of air entering through the air inlet 20*a* is relatively slow, a low level of sound is generated.

The curved portion 22 of the main body 20 is formed on the lower portion of the air inlet 20*a* of the main body 20 as shown in FIG. 2, and is formed to have the golf club P inserted thereinto and support the golf club P as shown in FIG. 4. Herein, the curved portion 22 has the substantially same inner diameter as the outer diameter of the golf club P, and comes into close contact with the golf club P when being mounted on the golf club P and is fixed to the golf club P.

In addition, a pad 30 is attached along the surface of the curved portion 22 as a gripping means. Herein, the pad 30 is attached to the curved portion 22 to serve to increase a grip force between the main body 20 and the golf club P.

The main body 20 may be formed of a light material such as plastic in consideration of weight when it is mounted on the golf club P. The pad 30 may be formed of rubber or silicon to be built between the main body 20 and the golf club P and fill a gap therebetween, or may be formed of other materials as long as the gap is filled.

In the first embodiment of the present invention, the sound generator 10 is mounted on the golf club P by inserting the lower portion of the golf club P having a relatively small diameter into the curved portion 22 of the main body 20, and pushing up the main body 20 to a portion having a relatively large diameter. In this case, the pad 30 is pressed between the curved portion 22 and the golf club P, thereby securely fixing the main body 20 to the golf club P.

According to the first embodiment of the present invention, the sound generator 10 has the gap between the curved portion 22 of the main body 20 and the golf club P filled using the pad 30 as a gripping means, such that the main body 10 is securely fixed to the golf club P through a simple operation.

FIG. 5 is a perspective view showing a sound generator for golf practice according to a second embodiment of the present invention, and FIG. 6 is a cross section view taken along line B-B of FIG. 5.

The sound generator 20 for golf practice according to the second embodiment of the present invention includes a main body 20 having a sound generation portion 21 and a curved portion 22, and a gripping means for keeping a golf club fixed to the curved portion 22 like in the first embodiment.

As shown in FIG. 6, the sound generation portion 21 includes an air inlet 20*a* formed on the front surface of the main body 20, an air outlet 20*b* formed on the top surface of the main body 20, and a sound generation space 20*c* formed inside the main body 20.

The gripping means includes a pad 30 formed along the surface of the curved portion 22, and a grip portion 40 extending from the curved portion 22 by means of a fixing means. Herein, the grip portion 40 is connected with the curved portion 22 of the main body 20 in a sliding manner, thereby enlarging a contact area with the golf club and thus enhancing a grip force.

As shown in FIG. 7, the grip portion 40 has a curved portion 42 formed on the front portion of a body 41 thereof and is configured to be connected with the main body 20 by sliding into the main body 20 by means of the fixing means. That is, the grip portion 40 is connected with the curved portion 22 of the main body 20 when the sound generator 10 is fixed to the golf club, and is disconnected from the curved portion 22 of the main body 20 when the sound generator 10 is released from the golf club.

In addition, the curved portion 42 of the grip portion 40 has the same curvature as that of the curved portion 22 of the main body 20, and a pad 43 is formed along the inner surface of the curved portion 42. Herein, the grip portion 40 may be formed of the same material as that of the main body 20 and the pad 43 of the grip portion 40 may also be formed of the same material as that of the pad 30 of the main body 20.

The fixing means for fixing the main body 20 and the grip portion 40 includes a first connection portion formed on the lower portion of the curved portion 22 to be connected in a sliding manner, and a second connection portion formed on the grip portion 40 to be engaged with the first connection portion.

The first connection portion includes an insertion groove 23 which is formed on the lower portion of the curved portion 22 to allow the body 41 of the grip portion 40 to be inserted thereinto; guide rail grooves 24 which are formed on the opposite side surfaces of the insertion groove 23 in parallel with each other in a longitudinal direction; a location determination hole 25 which is formed on the upper surface of the insertion groove 23 between the guide rail grooves 24; and a locking groove 26 formed on the rear portion of the insertion groove 23.

In addition, the second connection portion includes: guide rails 44 formed on the opposite sides of the body 41 of the grip portion 40 to be connected with the guide rail grooves 24 by sliding thereinto; a location determination protrusion 45 which is formed on the top surface of the body 41 to be connected with the location determination hole 25 by being inserted thereinto; and a locking projection 46 formed on the rear surface of the body 41 to be inserted into the locking groove 26.

Herein, in a similar way to that of a battery insertion slot on a remote control, the first connection portion and the second connection portion are connected with each other in such a manner that the body 41 of the grip portion 40 is pushed in the state in which the guide rails 44 of the grip portion 40 are inserted into the insertion groove 23 of the main body 20, and the locking projection 46 of the grip portion 40 is engaged with the locking groove 26 of the main body 20. On the other hand, the grip portion 20 is disconnected from the main body 20 by pressing the front portion of the body 41 of the grip portion 40 and pushing in the opposite direction while still pressing.

The first connection portion and the second connection portion are not limited to the configuration disclosed in the second embodiment, and can be changed in various forms by a person skilled in the art.

The sound generator 10 according to the second embodiment of the present invention further includes the grip portion 40 in addition to the pad 30 as a gripping means, thereby further enhancing the grip force between the main body 20 and the golf club, and the curved portion 22 of the main body 20 and the grip portion 40 are connected with each other in a sliding manner, such that the main body 20 can be easily mounted on or dismounted from the golf club.

FIG. 8 is an exploded perspective view showing a main body and a grip portion of a sound generator according to a third embodiment of the present invention.

The sound generator 20 for golf practice according to the third embodiment of the present invention includes a main body 20 having a sound generation portion 21 and a curved portion 22, and a gripping means for keeping a golf club fixed to the curved portion 22 like in the first and second embodiments.

In addition, like in the second embodiment, the sound generator 10 includes a pad 30 formed along the surface of the curved portion 22 of the main body 20, and a grip portion 40 extending from the curved portion 22 by means of a fixing means, thereby enlarging a contact area with the golf club. Herein, the grip portion 40 is connected with the curved portion 22 in a hooking manner, thereby enlarging the contact area with the golf club and enhancing a grip force.

As shown in FIG. 8, the grip portion 40 has a curved portion 42 formed on the front portion of a body 41 thereof and is configured to be connected with the main boy 20 by being hooked thereinto through the fixing means.

The fixing means includes a third connection portion formed on the lower portion of the curved portion 22 to be connected in the hooking method, and a fourth connection portion formed on the grip portion 40 to be engaged with the third connection portion.

The third connection portion includes an insertion groove 23 formed on the lower portion of the curved portion 22 of the main body 20 to allow the body 41 of the grip portion 40 to be inserted thereinto, locking grooves 27 formed on the opposite side surfaces of the insertion groove 23, and a location determination hole 28 formed on the upper surface of the insertion groove 23 between the locking grooves 27.

In addition, the fourth connection portion includes locking protrusions 47 formed on the opposite side surfaces of the body 41 of the grip portion 40 to be engaged with the locking grooves 27, and a fixing protrusion 48 formed on the top surface of the body 41 to be inserted into the location determination hole 28.

The third and fourth connection portions are not limited to the configuration disclosed in the third embodiment, and can be changed in various forms by a person skilled in the art.

The sound generator 10 according to the third embodiment of the present invention further includes the grip portion 40 in addition to the pad 30 as a gripping means, thereby further enhancing the grip force between the main body 20 and the golf club, and the curved portion 22 of the main body 20 and the grip portion 40 are connected with each other in a hooking manner, such that the main body 20 can be easily mounted on or dismounted from the golf club.

FIG. 9 is a perspective view showing a sound generator for golf practice according to a fourth embodiment of the present invention.

The sound generator 10 according to the fourth embodiment of the present invention includes a main body 20 having a sound generation portion 21 and a curved portion 22, a pad 30 formed on the curved portion 22 of the main body 20, and a grip portion 40 connected with the curved portion 22 of the main body 20 like in the second and third embodiments.

In addition, the sound generator 10 may include a display 50 formed on one side of the main body 20, for displaying an exercising time or the like. Herein, the display 50 may be configured for the user to check time when the user starts or finishes exercising by operating the display 50. The display 50 may be configured to interwork with a means for measuring a number of times of swings or a swing speed.

The sound generator 10 according to the fourth embodiment of the present invention includes the display 50 on the main body 20, such that the user can conveniently utilize the sound generator 10 by checking an exercising time when practicing golf.

While preferred embodiments of the present invention have been described, the present invention is not limited to the above-described specific embodiments of the present invention, and various changes can be made by a person skilled in the art without departing from the spirit and scope of the invention as defined by the appended claims. In addition, the features that can be easily inferred from the accompanying drawings should be regarded as being included in the disclosure of the present invention even if they are not described, and various changed embodiments should not be understood as being separate from the technical idea or aspect of the present invention.

What is claimed is:

1. A sound generator for golf practice, comprising:

a main body having a sound generation portion for generating a sound, and a curved portion for supporting a golf club; and a gripping member configured to keep the golf club fixed to the curved portion, wherein the sound generator allows air to flow into the main body in a swing direction every time the golf club is swung at a predetermined swing speed, and generates a sound in the sound generation portion, wherein the sound generation portion comprises an air inlet and an air outlet formed on a front surface and a top surface of the main body, respectively, and a sound generation space formed inside the main body, and is configured to allow a sound change according to a swing speed of the golf club, wherein the sound generation space is formed to have a passage gradually becoming narrower from the air inlet toward the inside of the main body and have a space relatively larger than the passage in the main body such that the sound generation portion is configured to generate a sound through resonance while air entering through the air inlet passes through the passage, is circulated along the sound generation space, and escapes through the air outlet.

2. The sound generator of claim 1, wherein the gripping member comprises:

a pad formed along a surface of the curved portion; and a grip portion extending from the curved portion by means of a fixing device, thereby enlarging a contact area with the golf club.

3. The sound generator of claim 2, wherein the fixing device comprises:

a first connection portion formed on a lower portion of the curved portion to be connected with the grip portion in a sliding manner; and a second connection portion formed on the grip portion to be engaged with the first connection portion.

4. The sound generator of claim 3, wherein the first connection portion comprises:

an insertion groove formed on the lower portion of the curved portion; guide rail grooves formed on opposite side surfaces of the insertion groove in parallel with each other in a longitudinal direction; a location determination hole formed on an upper surface of the insertion groove between the guide rail grooves; and a locking groove formed on a rear portion of the insertion groove, and wherein the second connection portion comprises: guide rails formed on opposite sides of a body of the grip portion to be connected with the guide rail grooves by sliding thereinto, a location determination protrusion formed on a top surface of the body to be inserted into the location determination hole; and a locking projection formed on a rear surface of the body to be connected with the locking groove.

5. A sound generator for golf practice, comprising:

a main body having a sound generation portion for generating a sound, and a curved portion for supporting a golf club;

a gripping member for keeping the golf club fixed to the curved portion;

wherein the sound generator allows air to flow into the main body in a swing direction every time the golf club is swung at a predetermined swing speed, and generates a sound in the sound generation portion;

and wherein the gripping member includes a pad formed along a surface of the curved portion, and a grip portion extending from the curved portion by means of a fixing device, thereby enlarging a contact area with the golf club;

and wherein the fixing means includes a first connection portion formed on a lower portion of the curved portion to be connected with the grip portion in a sliding manner, and a second connection portion formed on the grip portion to be engaged with the first connection portion; and wherein the first connection portion includes an insertion groove formed on the lower portion of the curved portion; guide rail grooves formed on opposite side surfaces of the insertion groove in parallel with each other in a longitudinal direction; a location determination hole formed on an upper surface of the insertion groove between the guide rail grooves; and a locking groove formed on a rear portion of the insertion groove, and wherein the second connection portion comprises: guide rails formed on opposite sides of a body of the grip portion to be connected with the guide rail grooves by sliding thereinto, a location determination protrusion formed on a top surface of the body to be inserted into the location determination hole; and a locking projection formed on a rear surface of the body to be connected with the locking groove.

* * * * *